US011084613B1

(12) United States Patent
Dove et al.

(10) Patent No.: US 11,084,613 B1
(45) Date of Patent: Aug. 10, 2021

(54) MEAT GRIND BAG FILLING FUNNEL ATTACHMENT

(71) Applicants: Brian Dove, Harrisonburg, VA (US); Christie Dove, Harrisonburg, VA (US)

(72) Inventors: Brian Dove, Harrisonburg, VA (US); Christie Dove, Harrisonburg, VA (US)

( * ) Notice: Subject to any disclaimer, the term of this patent is extended or adjusted under 35 U.S.C. 154(b) by 72 days.

(21) Appl. No.: 16/558,595

(22) Filed: Sep. 3, 2019

(51) Int. Cl.
*B65B 39/00* (2006.01)
*B67C 11/00* (2006.01)
*B67C 11/02* (2006.01)

(52) U.S. Cl.
CPC ..... *B65B 39/007* (2013.01); *B67C 11/00* (2013.01); *B67C 11/02* (2013.01)

(58) Field of Classification Search
CPC ..... B67C 11/00; B67C 11/02; B65B 39/007
USPC ..... 141/331–345
See application file for complete search history.

(56) References Cited

U.S. PATENT DOCUMENTS 2,580,811 A * 1/1952 Martinsen ..... B65D 25/48 222/460
2,605,582 A * 8/1952 Allen ..... A01K 69/06 43/100
2,623,671 A 12/1952 Firestone
2,827,931 A 3/1958 Melvin
4,248,278 A 2/1981 Blodgett
4,485,855 A 12/1984 Dillingham
4,896,707 A * 1/1990 Cowles ..... B67C 11/02 141/337
5,078,189 A * 1/1992 Ronsonet ..... B67C 11/02 141/331
5,121,779 A * 6/1992 Green ..... B67C 11/02 141/331
D375,878 S 11/1996 Morris
6,035,908 A 3/2000 Hoffmann
6,276,411 B1 * 8/2001 Veneziano ..... B67C 11/02 141/337
6,983,578 B1 1/2006 Suda
7,677,276 B2 * 3/2010 Sun ..... B67C 11/02 141/332
7,985,218 B2 * 7/2011 Dipoto ..... A61B 17/0293 606/1
2007/0062607 A1 * 3/2007 Salani ..... B67C 11/02 141/337

FOREIGN PATENT DOCUMENTS

WO 2001092108 12/2001

* cited by examiner

*Primary Examiner* — Timothy L Maust
(74) *Attorney, Agent, or Firm* — Kyle A. Fletcher, Esq.

(57) ABSTRACT

The meat grind bag filling funnel attachment is configured for use with a meat grinder. The meat grinder further comprises a discharge tube. The meat grind bag filling funnel attachment attaches to the discharge tube. The meat grind bag filling funnel attachment receives meat ground by the meat grinder and transports the received meat to a collection container designated to receive the ground meet. The meat grind bag filling funnel attachment comprises a funnel structure and a suspension structure. The funnel structure transports the meat ground by the meat grinder to the collection container. The suspension structure suspends the funnel structure from the discharge tube of the meat grinder.

15 Claims, 4 Drawing Sheets

MEAT GRIND BAG FILLING FUNNEL ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of performing operations including devices for packing materials in containers, more specifically, a funnel for guiding material into a container.

SUMMARY OF INVENTION

The meat grind bag filling funnel attachment is configured for use with a meat grinder. The meat grinder further comprises a discharge tube. The meat grind bag filling funnel attachment attaches to the discharge tube. The meat grind bag filling funnel attachment receives meat ground by the meat grinder and transports the received meat to a collection container designated to receive the ground meet. The meat grind bag filling funnel attachment comprises a funnel structure and a suspension structure. The funnel structure transports the meat ground by the meat grinder to the collection container. The suspension structure suspends the funnel structure from the discharge tube of the meat grinder.

These together with additional objects, features and advantages of the meat grind bag filling funnel attachment will be readily apparent to those of ordinary skill in the art upon reading the following detailed description of the presently preferred, but nonetheless illustrative, embodiments when taken in conjunction with the accompanying drawings.

In this respect, before explaining the current embodiments of the meat grind bag filling funnel attachment in detail, it is to be understood that the meat grind bag filling funnel attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the meat grind bag filling funnel attachment.

It is therefore important that the claims be regarded as including such equivalent construction insofar as they do not depart from the spirit and scope of the meat grind bag filling funnel attachment. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
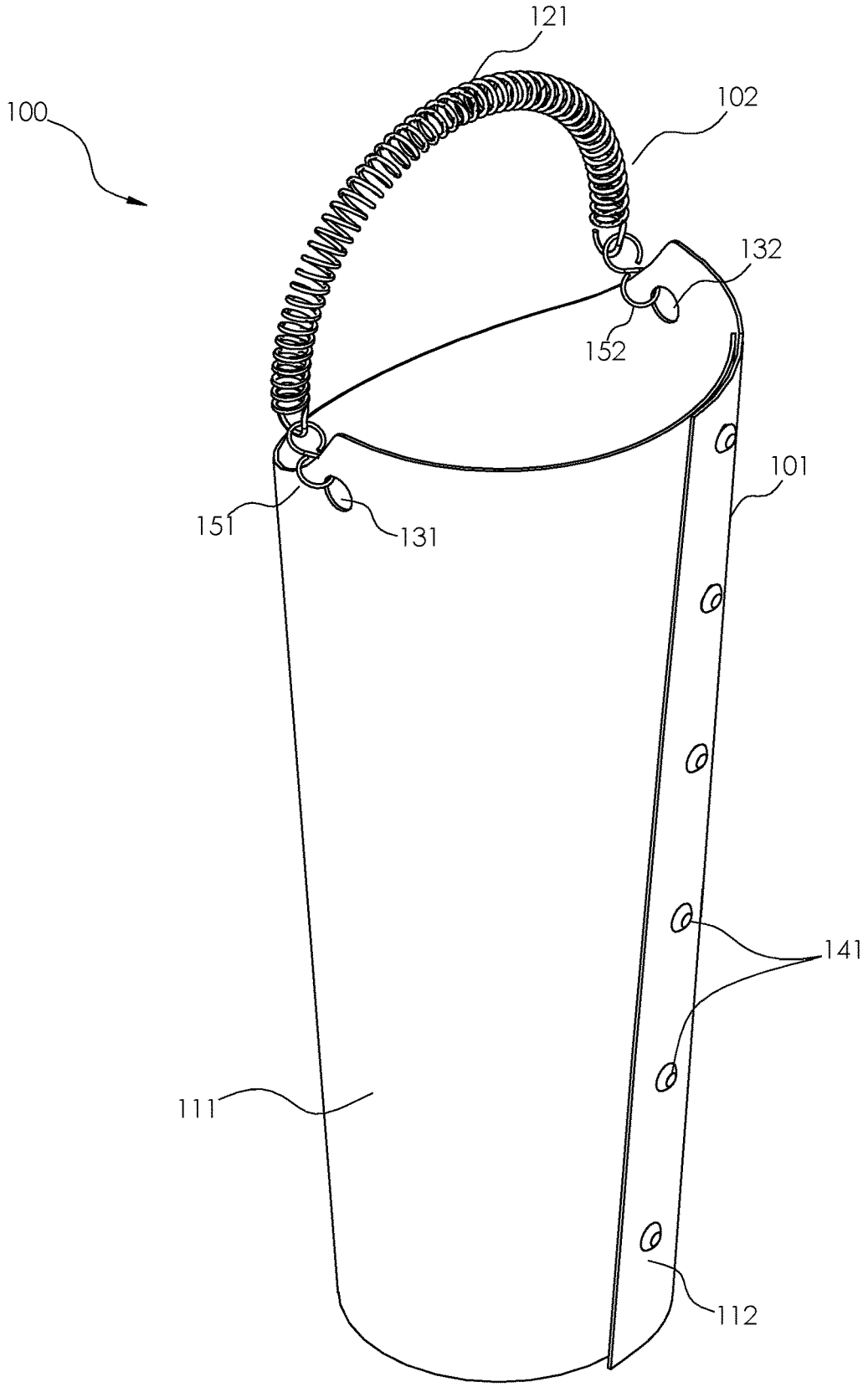
FIG. 1 is a perspective view of an embodiment of the disclosure.
Figure 2:
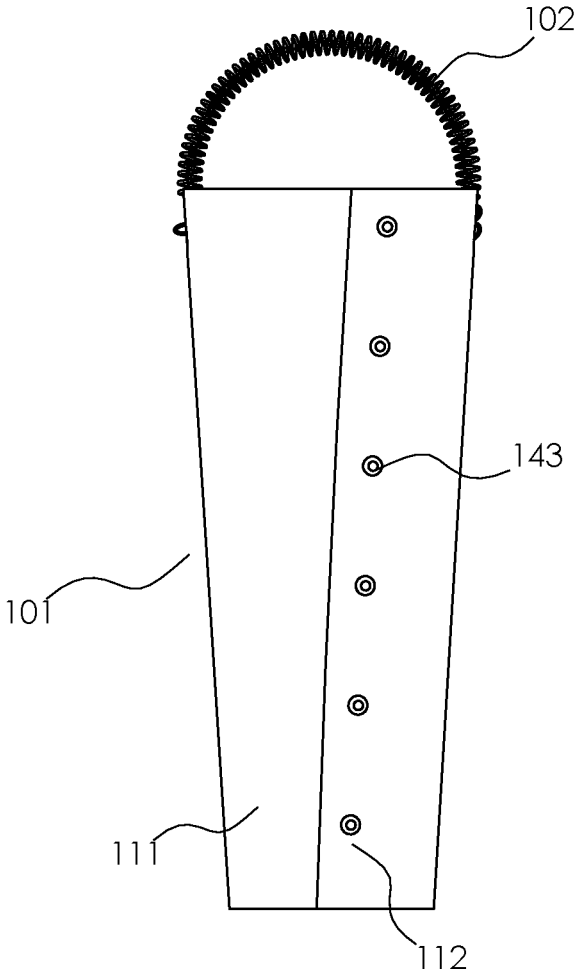
FIG. 2 is a front view of an embodiment of the disclosure.
Figure 3:
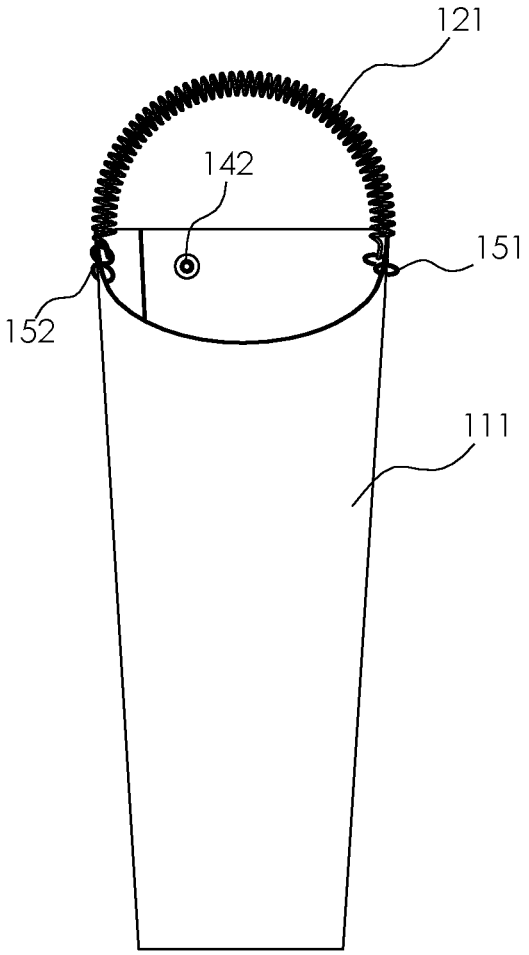
FIG. 3 is a rear view of an embodiment of the disclosure.
Figure 4:
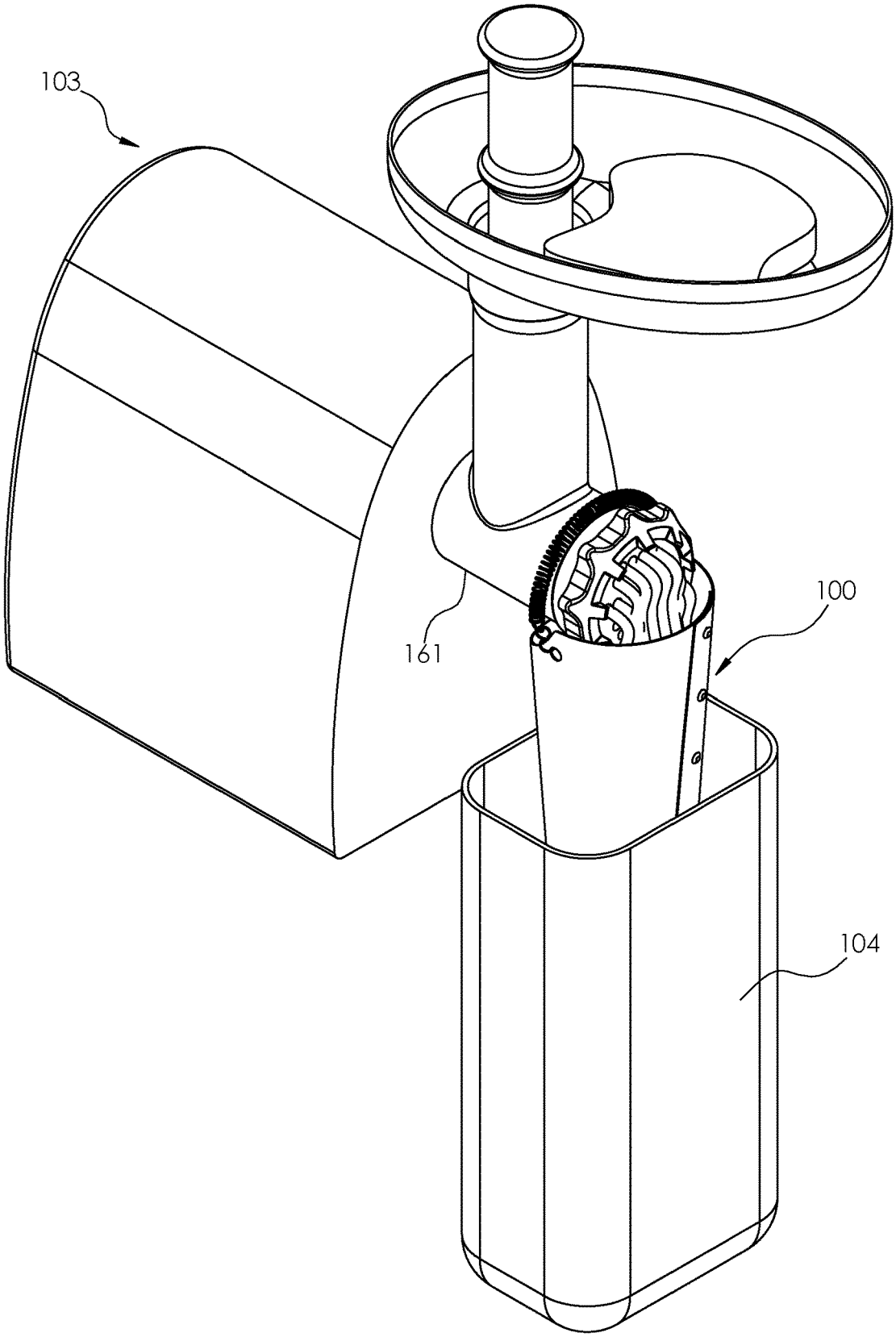
FIG. 4 is an in-use view of an embodiment of the disclosure.
Figure 5:
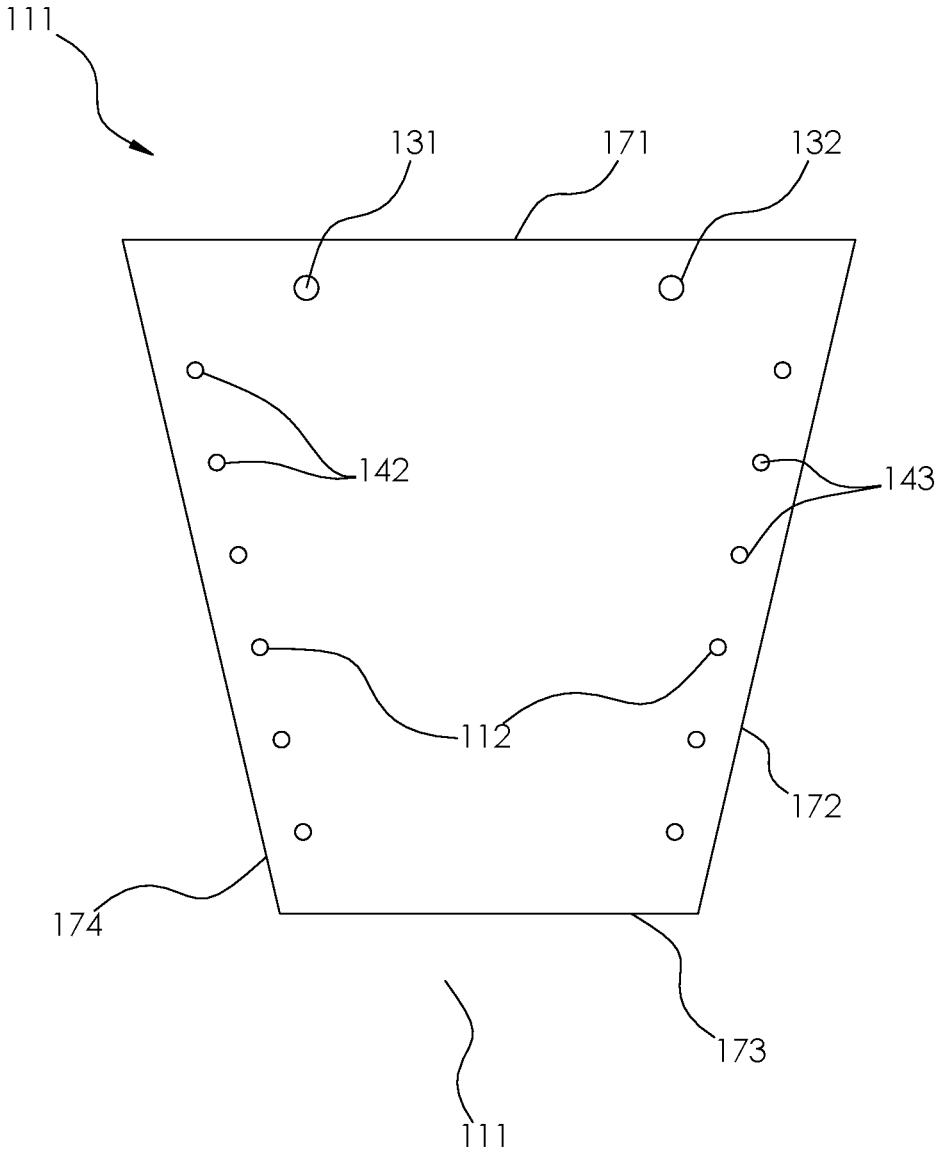
FIG. 5 is a detail view of an embodiment of the disclosure.

Detailed reference will now be made to one or more potential embodiments of the disclosure, which are illustrated in FIGS. 1 through 5.

The meat grind bag filling funnel attachment 100 (hereinafter invention) is configured for use with a meat grinder 103. The meat grinder 103 further comprises a discharge tube 161. The meat that is ground by the meat grinder 103 is discharged from the meat grinder 103 through the discharge tube 161. The invention 100 attaches to the discharge tube 161. The invention 100 receives meat ground by the meat grinder 103 and transports the received meat to a collection container 104 designated to receive the ground meet. The invention 100 comprises a funnel structure 101 and a suspension structure 102. The funnel structure 101 transports the meat ground by the meat grinder 103 to the collection container 104. The suspension structure 102 suspends the funnel structure 101 from the discharge tube 161 of the meat grinder 103.

The meat grinder 103 is a mechanical device. The meat grinder 103 is a well-known and documented device that grinds meat. The collection container 104 is a hollow structure. The collection container 104 is configured to receive the ground material discharged from the discharge tube 161 from the meat grinder 103.

The funnel structure 101 is a mechanical structure. The funnel structure 101 is a hollow tubular structure. The funnel structure 101 has the shape of a truncated pyramid. The funnel structure 101 receives material discharged from the discharge tube 161 from the meat grinder 103 and transports the collected material into the collection container 104. The funnel structure 101 comprises a sheeting 111 and a sheeting 111 fastener 112.

The sheeting 111 is a flat structure formed from a water insoluble polymer. The sheeting 111 is a flexible structure. The sheeting 111 has a trapezoidal shape. The sheeting 111 folds upon itself to form a funnel used to collect material discharged from the discharge tube 161 from the meat grinder 103 and to transport the collected material into the collection container 104. The sheeting 111 further comprises a first anchor aperture 131 and a second anchor aperture 132. The sheeting 111 is further defined with a first edge 171, a second edge 172, a third edge 173, and a fourth edge 174.

The first edge 171 is the edge of the trapezoidal shape that forms the sheeting 111 that is distal from the third edge 173. The span of the length of the first edge 171 is greater than the span of the length of the third edge 173. The second edge 172 is the edge of the trapezoidal shape that forms the sheeting 111 that connects the first edge 171 to the third edge 173 of the sheeting 111. The third edge 173 is the edge of the trapezoidal shape that forms the sheeting 111 with the least span of length. The fourth edge 174 is the edge of the trapezoidal shape that forms the sheeting 111 that is distal from the second edge 172.

The first anchor aperture 131 is a first negative space formed through the faces of the sheeting 111 that forms the primary structure of the funnel structure 101. The first anchor aperture 131 forms an anchor point used to attach the suspension structure 102 to the funnel structure 101.

The second anchor aperture 132 is a second negative space formed through the faces of the sheeting 111 that forms the primary structure of the funnel structure 101. The second anchor aperture 132 forms an anchor point used to attach the suspension structure 102 to the funnel structure 101.

The sheeting 111 fastener 112 is a mechanical device. The sheeting 111 fastener 112 holds the sheeting 111 in the truncated pyramid shape after the folding of the sheeting 111. In the first potential embodiment of the disclosure, the sheeting 111 fastener 112 comprises a plurality of snaps 141. Each of the plurality of snaps 141 is a fastening device commonly referred to as a snap. The elements of each of the plurality of snaps 141 attach to the face of the sheeting 111 of the funnel structure 101. Each of the plurality of snaps 141 fastens the sheeting 111 of the funnel structure 101 to itself to create the truncated pyramid structure of the funnel structure 101. The plurality of snaps 141 comprises a plurality of first components 142 and a plurality of second components 143.

Each of the plurality of first components 142 comprises a first attachment component of a fastening structure known as a snap. Each of the plurality of first components 142 are identical. Each of the plurality of first components 142 attach to a first face of the sheeting 111 such that the plurality of first components 142 forms a linear structure that is parallel to the fourth edge 174 of the sheeting 111.

Each of the plurality of second components 143 comprises a second attachment component of a fastening structure known as a snap. Each of the plurality of second components 143 are identical. Each of the plurality of second components 143 attach to a second face of the sheeting 111 such that the plurality of second components 143 forms a linear structure that is parallel to the second edge 172 of the sheeting 111. The second face of the sheeting 111 is the face of the sheeting 111 that is opposite to the first face of the sheeting 111.

Each of the plurality of second components 143 are positioned on the sheeting 111 such that each second component selected from the plurality of second components 143 aligns with a first component selected from the plurality of first components 142 such that the selected second component aligns with and attaches to the selected first component when the sheeting 111 is folded to form the truncated pyramid structure of the funnel structure 101.

The suspension structure 102 is a fastening device. The suspension structure 102 attaches the funnel structure 101 to the meat grinder 103. Specifically, the suspension structure 102 suspends the funnel structure 101 from the discharge tube 161 of the meat grinder 103. The suspension structure 102 positions the funnel structure 101 relative to the discharge tube 161 of the meat grinder 103 such that the suspension structure 102 collects the material discharged from the discharge tube 161 from the meat grinder 103. The suspension structure 102 positions the funnel structure 101 relative to the collection container 104 such that the funnel structure 101 deposits the collected material into the collection container 104. The suspension structure 102 comprises a helical coil spring 121, a first hook 151, and a second hook 152.

The helical coil spring 121 is a tension coil spring that rests on the superior surface of the discharge tube 161 of the meat grinder 103. The helical coil spring 121 is placed over the superior surface of the discharge tube 161 of the meat grinder 103. The funnel structure 101 attaches to the ends of the helical coil spring 121 such that the helical coil spring 121 suspends the funnel structure 101 above a supporting surface. The helical coil spring 121 forms a load path that transfers the load of the funnel structure 101 to the meat grinder 103.

The first hook 151 is a hook that attaches to a first end of the linear structure formed by the helical coil spring 121. The first hook 151 attaches the helical coil spring 121 to the first anchor aperture 131 of the sheeting 111 such that the helical coil spring 121 suspends the funnel structure 101 from the discharge tube 161 of the meat grinder 103.

The second hook 152 is a hook that attaches to a second end of the linear structure formed by the helical coil spring 121. The second hook 152 attaches the helical coil spring 121 to the second anchor aperture 132 of the sheeting 111 such that the helical coil spring 121 suspends the funnel structure 101 from the discharge tube 161 of the meat grinder 103.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Aperture: As used in this disclosure, an aperture is a prism-shaped negative space that is formed completely through a structure or the surface of a structure.

Cavity: As used in this disclosure, a cavity is an empty space or negative space that is formed within an object. See Saucer Copolymer: As used in this disclosure, a copolymer is a polymer formed from two or more repeating molecules (also referred to as monomers).

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Fastener: As used in this disclosure, a fastener is a device that is used to join or affix two objects. Fasteners generally comprise a first element which is attached to the first object and a second element which is attached to the second object such that the first element and the second element join to removably attach the first object and the second object. Common fasteners include, but are not limited to, hooks, zippers, magnets, snaps, buttons, buckles, quick-release buckles, or hook and loop fasteners.

Flexible: As used in this disclosure, flexible refers to an object or material that will deform when a force is applied to it but that will not necessarily return to its original shape when the deforming force is removed.

Fold: As used in this disclosure, to fold means to bend an object back upon itself.

Force of Gravity: As used in this disclosure, the force of gravity refers to a vector that indicates the direction of the pull of gravity on an object at or near the surface of the earth.

Funnel: As used in this disclosure, a funnel is a cone-shaped object with: 1) openings at the apex and base of the frustum of a cone; and, 2) a hollow discharge pipe located at the apex of the frustum of the cone.

Helical Spring: As used in this disclosure, a helical spring is a compression spring shaped in the form of a cylindrical helix.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Hook: As used in this disclosure, a hook is an object that is curved or bent at an angle such that items can be hung on or caught by the object.

Inferior: As used in this disclosure, the term inferior refers to a directional reference that is parallel to and in the same direction as the force of gravity when an object is positioned or used normally.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Monomer: As used in this disclosure, a monomer refers to a molecular structure that bonds to itself in a repeating manner to form a polymer.

N-gon: As used in this disclosure, an N-gon is a regular polygon with N sides wherein N is a positive integer number greater than 2.

Negative Space: As used in this disclosure, negative space is a method of defining an object through the use of open or empty space as the definition of the object itself, or, through the use of open or empty space to describe the boundaries of an object.

Polymer: As used in this disclosure, a polymer refers to a molecular chain that comprises multiple repeating units known as monomers. The repeating unit may be an atom or a molecular structure.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Relaxed Shape: As used in this disclosure, a structure is considered to be in its relaxed state when no shear, strain, or torsional forces are being applied to the structure.

Sheeting: As used in this disclosure, a sheeting is a material, such as a paper, textile, a plastic, or a metal foil, in the form of a thin flexible layer or layers.

Snap: As used in this disclosure, a snap is a fastener that comprises a first component and a second component. The snap is engaged by pressing the first component into or against the second component.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Superior: As used in this disclosure, the term superior refers to a directional reference that is parallel to and in the opposite direction of the force of gravity when an object is positioned or used normally.

Suspend: As used in this disclosure, to suspend an object means to support an object such that the inferior end of the object does not form a significant portion of the load path of the object. Include inferior superior and load path.

Tension Spring: As used in this disclosure, a tension spring, also commonly referred to as an extension spring and a helical coil spring, is a wire coil that resists forces attempting to pull the wire coil in the direction of the center axis of the wire coil. The tension spring will return to its original position when the pulling force is removed.

Trapezoid: As used in this disclosure, a trapezoid is a quadrilateral with one pair of parallel sides. An isosceles trapezoid is a trapezoid for which a line exists that: 1) intersects opposite sides of the trapezoid; and, 2) bisects the trapezoid into two congruent shapes or structures.

Truncated: As used in this disclosure, a geometric object is truncated when an apex, vertex, or end is cut off by a line or plane.

Truncated Pyramid: As used in this disclosure, a truncated pyramid is a frustum that remains when the apex of a pyramid is truncated by a plane that is parallel to the base of the pyramid.

Tube: As used in this disclosure, the term tube is used to describe a rigid hollow prism-shaped device with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A meat grind bag filling funnel attachment comprising a funnel structure and a suspension structure;

wherein the meat grind bag filling funnel attachment is configured for use with a meat grinder;

wherein the meat grind bag filling funnel attachment is configured to attach to a discharge tube of said meat grinder;

wherein the meat grind bag filling funnel attachment is adapted to receive material ground by the meat grinder and transports the received meat to a collection container designated to receive the ground meet;

wherein the suspension structure is configured to attach the funnel structure to the meat grinder;

wherein the funnel structure transports the material received from the meat grinder to a collection container;

wherein the funnel structure has the shape of a truncated pyramid;

wherein the funnel structure comprises a sheeting and a sheeting fastener;

wherein the sheeting folds upon itself to form a funnel used to collect material discharged from the discharge tube from the meat grinder and to transport the collected material into the collection container;

wherein the sheeting fastener holds the sheeting in the truncated pyramid shape after the folding of the sheeting;

wherein the sheeting is a flat structure formed from a water insoluble polymer;

wherein the sheeting has a trapezoidal shape;

wherein the sheeting is further defined with a first edge, a second edge, a third edge, and a fourth edge;

wherein the first edge is the edge of the trapezoidal shape that forms the sheeting that is distal from the third edge;

wherein the span of the length of the first edge is greater than the span of the length of the third edge;

wherein the second edge is the edge of the trapezoidal shape that forms the sheeting that connects the first edge to the third edge of the sheeting;

wherein the third edge is the edge of the trapezoidal shape that forms the sheeting with the least span of length;

wherein the fourth edge is the edge of the trapezoidal shape that forms the sheeting that is distal from the second edge;

wherein the sheeting further comprises a first anchor aperture and a second anchor aperture;

wherein the first anchor aperture is a first negative space formed through the faces of the sheeting that forms a primary structure of the funnel structure;

wherein the first anchor aperture forms an anchor point used to attach the suspension structure to the funnel structure;

wherein the second anchor aperture is a second negative space formed through the faces of the sheeting that forms the primary structure of the funnel structure;

wherein the second anchor aperture forms an anchor point used to attach the suspension structure to the funnel structure.

2. The meat grind bag filling funnel attachment according to claim 1 wherein the funnel structure is a mechanical structure;

wherein the funnel structure is a hollow tubular structure.

3. The meat grind bag filling funnel attachment according to claim 2 wherein the sheeting is a flexible structure.

4. The meat grind bag filling funnel attachment according to claim 3 wherein the sheeting fastener comprises a plurality of snaps;

wherein elements of each of the plurality of snaps attach to a face of the sheeting of the funnel structure.

5. The meat grind bag filling funnel attachment according to claim 4 wherein each of the plurality of snaps fastens the sheeting of the funnel structure to itself to create the truncated pyramid structure of the funnel structure.

6. The meat grind bag filling funnel attachment according to claim 5 wherein the plurality of snaps comprises a plurality of first components and a plurality of second components;

wherein each of the plurality of first components comprises a first attachment component of a fastening structure known as a snap;

wherein each of the plurality of second components comprises a second attachment component of a fastening structure known as a snap.

7. The meat grind bag filling funnel attachment according to claim 6 wherein each of the plurality of first components are identical;

wherein each of the plurality of second components are identical.

8. The meat grind bag filling funnel attachment according to claim 7 wherein each of the plurality of first components attach to a first face of the sheeting such that the plurality of first components forms a linear structure that is parallel to the fourth edge of the sheeting;

wherein each of the plurality of second components attach to a second face of the sheeting such that the plurality of second components forms a linear structure that is parallel to the second edge of the sheeting;

wherein the second face of the sheeting is the face of the sheeting that is opposite to the first face of the sheeting.

9. The meat grind bag filling funnel attachment according to claim 8 wherein each of the plurality of second components are positioned on the sheeting such that each second component selected from the plurality of second components aligns with a first component selected from the plurality of first components such that the selected second component aligns with and attaches to the selected first component when the sheeting is folded to form the truncated pyramid structure of the funnel structure.

10. The meat grind bag filling funnel attachment according to claim 9 wherein the suspension structure is a fastening device;

wherein the suspension structure suspends the funnel structure from the discharge tube of the meat grinder.

11. The meat grind bag filling funnel attachment according to claim 10 wherein the suspension structure positions the funnel structure relative to the discharge tube of the meat grinder such that the suspension structure collects the material discharged from the discharge tube from the meat grinder;

wherein the suspension structure positions the funnel structure relative to the collection container such that the funnel structure deposits the collected material into the collection container.

12. The meat grind bag filling funnel attachment according to claim 11 wherein the suspension structure comprises a helical coil spring, a first hook, and a second hook;

wherein the first hook and the second hook attach to a helical coil spring.

13. The meat grind bag filling funnel attachment according to claim 12 wherein the helical coil spring is a tension coil spring;

wherein the helical coil spring is placed over the superior surface of the discharge tube of the meat grinder;

wherein the funnel structure attaches to the ends of the helical coil spring such that the helical coil spring suspends the funnel structure.

14. The meat grind bag filling funnel attachment according to claim 13 wherein the first hook is a hook that attaches to a first end of a linear structure formed by the helical coil spring;

wherein the first hook attaches the helical coil spring to the first anchor aperture of the sheeting such that the helical coil spring suspends the funnel structure from the discharge tube of the meat grinder.

15. The meat grind bag filling funnel attachment according to claim 14 wherein the second hook is a hook that attaches to a second end of the linear structure formed by the helical coil spring;

wherein the second hook attaches the helical coil spring to the second anchor aperture of the sheeting such that the helical coil spring suspends the funnel structure from the discharge tube of the meat grinder.

* * * * *